United States Patent [19]

Ibel

[11] 4,145,767

[45] Mar. 27, 1979

[54] COMBINATION WATER CLOSET AND BIDET

[76] Inventor: Manfred Ibel, 178 Fifth Ave., New York, N.Y. 10010

[21] Appl. No.: 774,016

[22] Filed: Mar. 3, 1977

[51] Int. Cl.[2] ..... A61H 35/00

[52] U.S. Cl. ..... 4/6; 4/235; 4/237; 4/353; 4/420

[58] Field of Search ..... 4/6, 7, 12, 97, 235, 4/236, 237, 353, 420

[56] References Cited

U.S. PATENT DOCUMENTS

| | | | |
|---|---|---|---|
| 303,027 | 8/1884 | McComb | 4/7 |
| 2,036,984 | 4/1936 | Salvoni | 4/6 |
| 2,036,985 | 4/1936 | Salvoni | 4/7 |
| 2,070,622 | 2/1937 | Salvoni | 4/7 |
| 2,080,438 | 5/1937 | Salvoni | 4/6 |
| 3,072,918 | 1/1963 | McCall | 4/6 |
| 3,336,602 | 8/1967 | Kubit | 4/97 |
| 3,490,079 | 1/1970 | Stolbach | 4/6 |
| 3,577,567 | 5/1971 | Wintercorn | 4/7 |

*Primary Examiner*—Richard E. Aegerter

*Assistant Examiner*—L. Footland

[57] ABSTRACT

A composite water closet and bidet includes a bowl defining a water basin having a rear edge portion on which a storage tank is positioned, in fluid communication with the water basin. A toilet seat having an opening therein is pivotally mounted on the bowl to provide a seating surface on the rim of the bowl. A bidet basin is pivotally mounted on the bowl above the seat and has a peripheral seating flange overlying the seating surface of the toilet seat as well as a basin portion which extends through the opening of the toilet seat into the water basin of the bowl. The bowl rim, toilet seat, and bidet have a generally complementary peripheral configuration to provide a uniform and neat appearance, as well as comfortable seating. The water tank has a front surface which includes a bulbous portion formed therein that is generally complementary to a portion of the basin of the bidet whereby the bulbous portion of the tank is received in the bidet basin, when the bidet basin is pivoted upwardly towards the tank, to expose the toilet seat and provide a compact storage configuration for the raised bidet basin.

24 Claims, 9 Drawing Figures

COMBINATION WATER CLOSET AND BIDET

The present invention relates to composite water closets and bidets, and more particularly to a unitary structure including the facilities of a water closet and a bidet in a compact configuration which is easy to use.

The concept of a combination water closet and bidet is relatively old, having been disclosed at least as early as 1881 in U.S. Pat. No. 244,219. The basic arrangement for bidets with water closets is to provide a bidet which is adapted to be mounted on a pre-existing water closet or toilet, that was not originally designed for use with the bidet structure. Many of these combined water closet and bidet bowls simply consist of the conncept of a removable basin adapted to be seated on the conventional toilet seat, as for example is disclosed in the above mentioned patent and also in U.S. Pat. Nos. 2,947,994; 3,072,918; 3,490,079; 3,577,567; and 3,654,636. Other types of combination water closet and bidets provide a bidet basin which is mounted on either the conventional toilet seat itself or on the water closet or bowl. This is shown for example in U.S. Pat. Nos. 1,348,518; 1,612,665; 1,655,864 and 3,879,769. Perhaps the most work in this area,, at least with respect to patented combined water closets and bidets, appears to have been performed during the 1930's by Ippolito Salvoni, who was awarded a large number of patents on a variety of different types of combined water closet and bidet structures; these patents include U.S. Pat. Nos. 2,036,984; 2,036,985; 2,070,622; 2,075,061; 2,075,830; and 2,104,210.

In almost all of the above mentioned combination water closet annd bidet, a bidet basin is provided which is adapted to be mounted on a pre-existing water closet facility. Thus the bidet basin is an afterthought, whichh must be accommodated to the limitations of the existing water closet. As a result fairly complicated mounting arrangements are provided for the bidet basin, and relatively complicated water supply conduits and arrangements must be provided. In addition, because the bidet basin is, in effect, an afterthought, the resulting structure has an extremely awkward and unpleasant appearance, since the parts are not matched to each other in a unitary integral design. As a result, although the use of bidets is popular where they are available, because of their complexity and unsightly appearance combination water closet and bidet structures, such as described in the above-mentioned patents, have not become popular or commercially available.

Accordingly, it is an object of the present invention to provide a composite or combined water closet and bidet which has a compact and attractive appearance.

Another object of the invention is to provide a composite or combined water closet and bidet which is sanitary to use and relatively easy to clean and maintain.

Another object of the present invention is to provide a unitized structure for a composite water closet and bidet in which the elements mate and cooperate with each other.

Yet another object of the present invention is to provide a composite water closet and bidet which can be readily and comfortably used as either a water closet or a bidet.

Yet another object of the present invention is to provide a composite water closet and bidet that is particularly adapted for mass production.

In accordance with an aspect of the present invention the composite water closet and bidet includes a bowl defining a water basin, the bowl having an upper rim including a rear edge portion. The toilet seat is pivotally mounted on the bowl adjacent the rear edge portion thereof and overlies the rim. The toilet seat has an opening therein providing a seating surface on the bowl. A bidet basin is pivotally mounted on the bowl adjacent the rear edge portion thereof above the seat annd the bidet basin has a peripheral seating flange overlying the seating surface of the toilet seat and a basin portion extending through the opening of the seat into the bowl.

The toilet seat seating surface and the bidet flange seating surface have generally complementary configurations in plan, with configurations are also generally complementary to the rim of the bowl.

A water tank is mounted on the rear end of the bowl in fluid communication with the water basin. The tank has a front surface including a bulbous central portion peripherally surrounded on its top and sides by relatively flat portions of the front surface of the tank. The bulbous portion of the tank extends outwardly therefrom and has a surface configuration that is generally complementry to a portion of the basin of the bidet when the bidet basin is provided upwardly towards the tank, thereby to provide a compact storage configuration for the raised bidet basin.

The above, and other objects, features and advantages of this invention will be apparent in the following detailed description as of an illustrative embodiment thereof, which is to be read in connection with the accompanying drawings, wherein.

Figure 1:
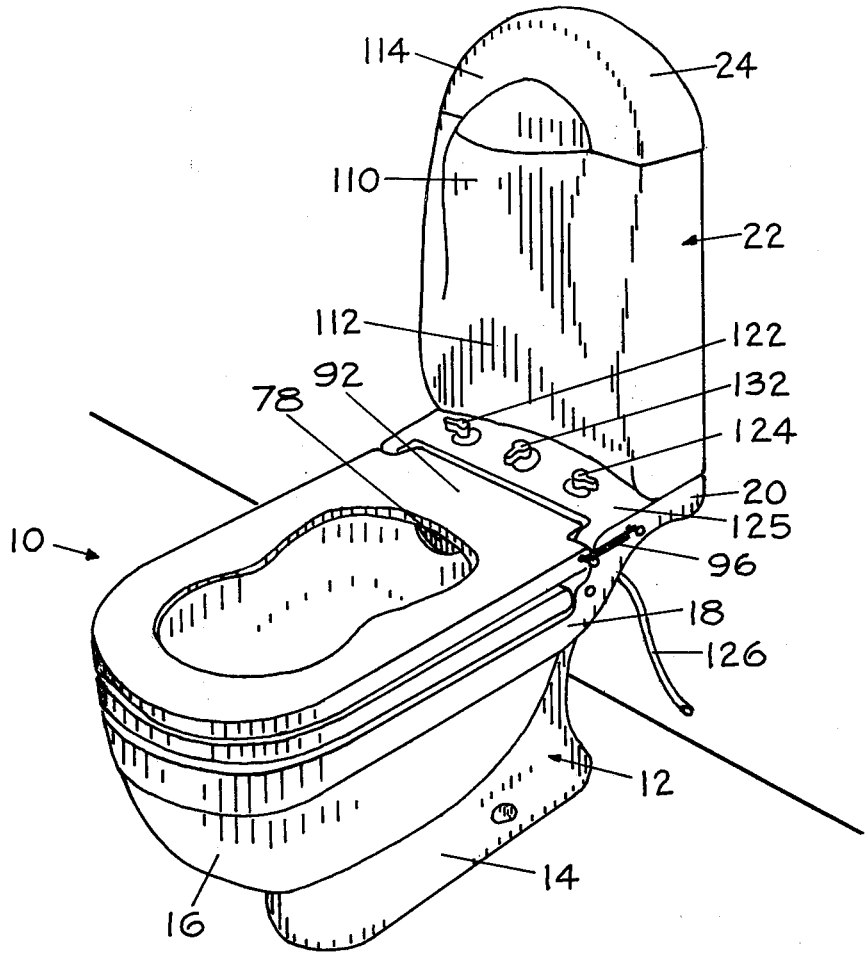
FIG. 1 is a perspective view of a composite water closet and bidet construction in accordance with the present invention.
Figure 6:
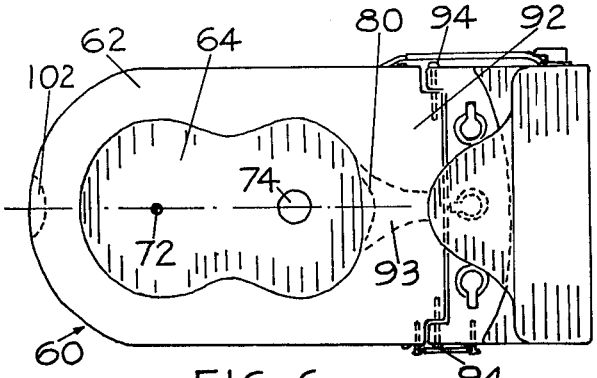
Figure 5A:
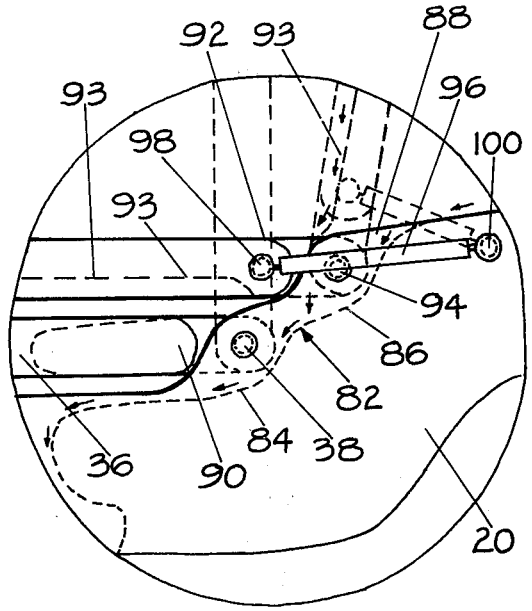
FIG. 5 is an elevational sectional view of the device shown in FIG. 1.
Figure 7:
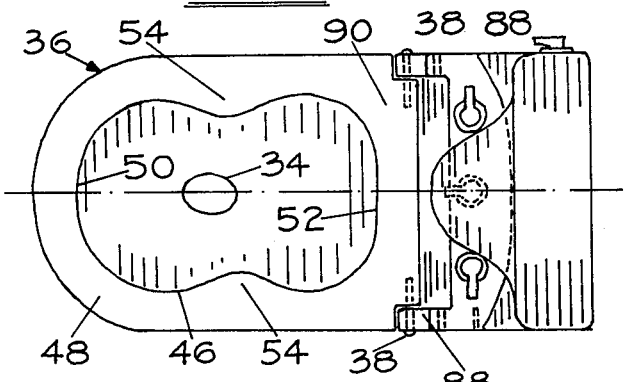

FIG. 5*a* is an enlarged partial side view showing the hinge arrangement for the water closet seat and bidet basin by which these elements are pivotally mounted on the bowl;

FIG. 6 is a plan view of the apparatus shown in FIG. 1 with the bidet basin down;

FIG. 7 is a plan view, similar to FIG. 6, but with the biget basin removed; and

Figure 4:
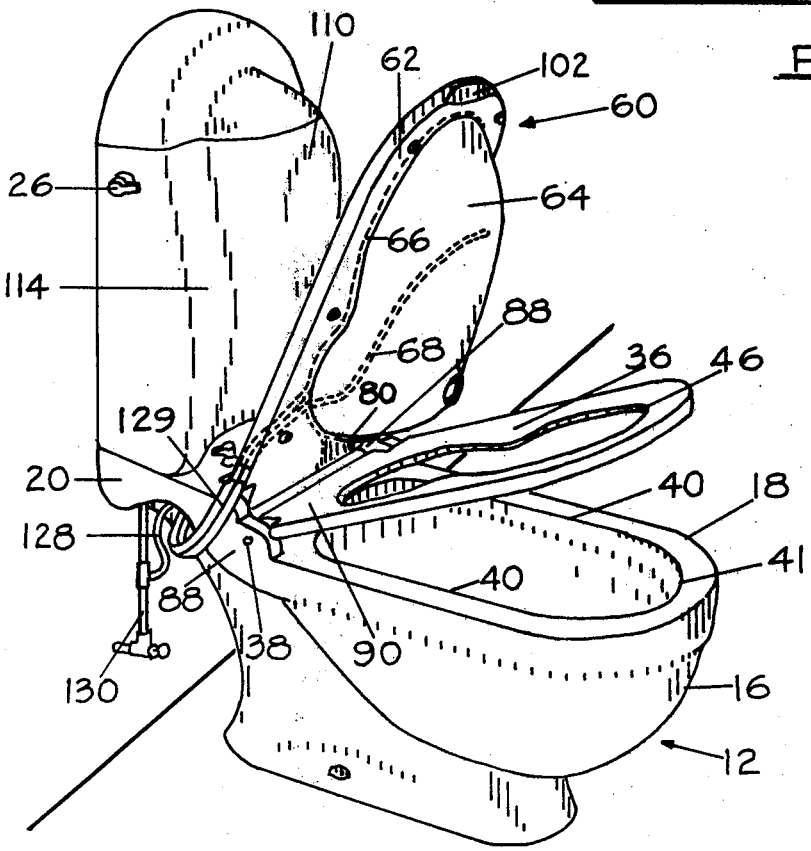
FIG. 4 is a perspective view of the device shown in FIG. 1 illustrating the water closet seat and the bidet basin in partially raised positions.
Figure 8:
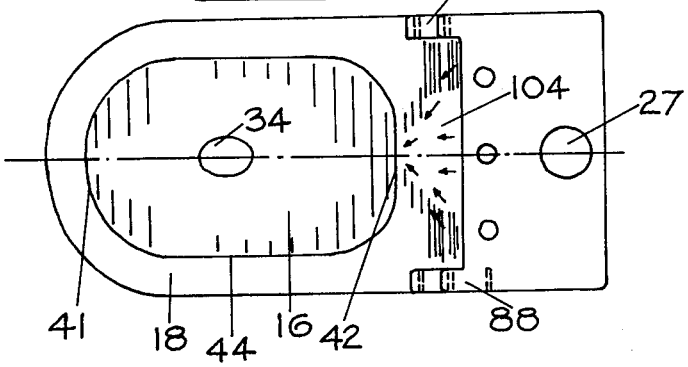
Figure 5:
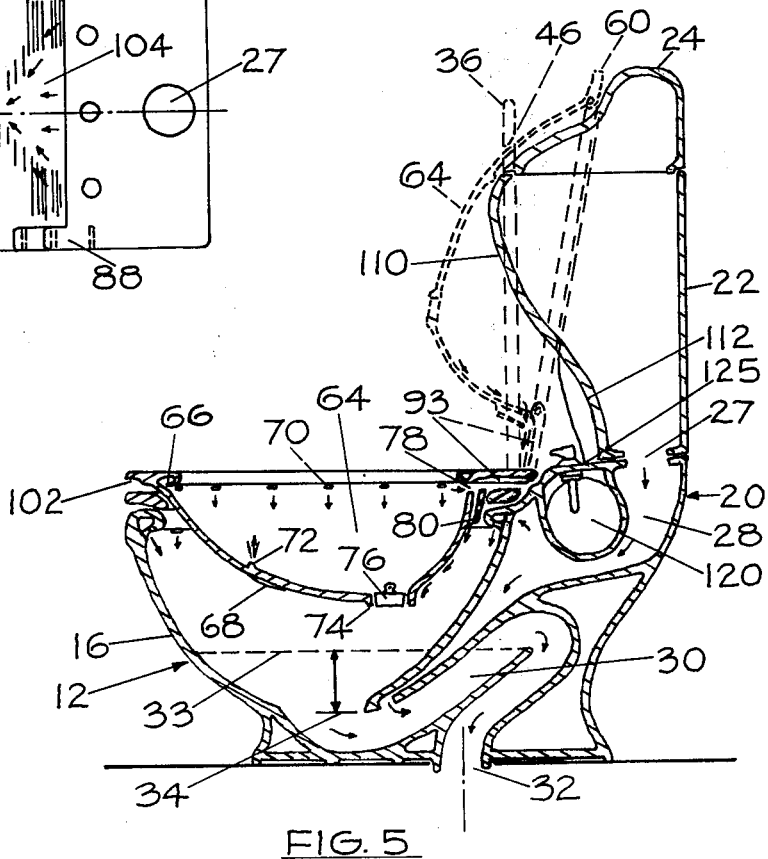

FIG. 8 is a plan view, similar to FIG. 7, but with the toilet seat and water tank removed. to Referring now to the drawings in detail and initially to FIGS. 1-5 thereof, a composite or combination water closet and bidet device or facility 10 is illustrated. The composite facility includes a bowl 12, which may be formed of a ceramic material in this conventional manner, having a base 14, an upper portion which defines a water basin 16, and a peripheral upper rim 18 surrounding the top edge of the water basin. Rim 18 has a rear extension 20 on which a water tank 22 is mounted in any conventional manner. The tank has a top 24, which is removably seated on the body of the tank 22, as seen in FIG. 5. Tank 22 serves to contain a supply of water, in the conventional manner, for use in flushing bowl 12, upon operation of the flush handle 26. A flushing mechanism (not shown) is contained within the tank 22 to permit the bowl to be flushed.

As illustrated in FIG. 5, tank 22 communicates with the water basin formed in the upper portion 16 of bowl 12 through a bottom opening 27 and a water passae 28 formed in the bowl. The water passage permits water to flow from tank 22 when opening 27 is opened upon operation of the flushing mechanism 26, into the water basin 16 in bowl 12, in the conventional manner. The water from the water basin of bowl 12 then flows through a siphon passage 30 to a drain 32 in the conventional manner. It is noted that siphon passage 30 has a relatively low profile so that the water level 33 in basin 16 is maintained at a relatively low level, for reasons described hereinafter, but that level is at least three inches above the drain opening 34 in the bottom of the bowl,, as required by most sanitary codes.

The composite facility of the present invention is adapted to be used both as a conventional toilet and as a bidet. For this purpose bowl 12 is provided with a seat 36 that is pivotally mounted by remobable pins 38 or the like at the rear edge of the seat on bowl 12.

In the illustrative embodiment of the invention rim 18 of the bowl has a generally oval shape, including relatively straight flat sides 40 extending parallel to each other, with a curved or arcuate front end 41 and a relatively curved rear end portion 42. The bowl is provided in dimensionns approximately equeal to the standard dimensions of conventional toilet facilities, but the length of the opening 44 defined by the rim 18 to the basin 16 is somewhat larger than conventional toilet facilities.

Seat 36 has a peripheral configuration which is substantially complementary to the peripheral configuration of bowl rim 18, and has an opening 46 formed therein. As illustrated in FIG. 7, the seat provides a seating surface 48 for the user, with opening 46 having a generally pear shaped configuration. That is, opening 46 is generally complementary at its front and rear ends 50, 52 respectively to the front and rear edge configuration of the inner edge of the rim 18, but is provided with inwardly extending extensions 54 that provide additional seating support for the user, particularly since the length of opening 46 is somewhat larger than the normal size opening in conventional toilet facilities. This arrangement enables the user to sit on the forward position of the seat.

A bidet 60 is also pivotally mounted on bowl 12 above seat 36. This bidet basin is preferably formed as an integral molded plastic element, including an outwardly extending flange 62 and an integral basin 64. As illustrated in FIG. 6, flange 62 is generally complementary in its peripheral configuration to the peripheral configuration of seat 36 and bowl rim 18. Flange 62 also is generally complementary to the seating surface 48 of toilet seat 36, but is slightly wider than seat 46 so that the basin 64 of the bidet is slightly smaller than toilet seat opening 46 and the basin can extend through that opening into the upper portion of bowl 12, as illustrated in FIG. 4.

Bidet 60 includes a pair of integral passages 66, 68 formed therein for supplying water to the interior of the bidet basin 64. Passage 66 has a plurality of openings 70 formed therein along its inner side, as illustrated in FIG. 5, to provide a rim flow of water to the basin. Passage 68 terminates in an upwardly directed nozzle 72 in the bottom portion of bidet basin 64, to provide a cleansing spray in the bidet. In use, a person will sit on the bidet facing tank 22 and use the water in basin portion 64 and from spray 72 in the conventional manner for a bidet. In this connection it is noted that the inner edge of flange 62 on the bidet extends inwardly above the bidet above opening 70 (see FIG. 5) to prevent water discharged from these openings from spraying or splashing upwardly.

To facilitate drainage of bidet basin 64, the bottom of the basin is provided with an opening 74 which is selectively opened and closed by a manually removable stopper 76 or the like. In addition bidet basin 64 includes a rear opening 78 formed as an overflow drain therein at its upper edge adjacent flange 62. A shield 80 is formed behind the opening in spaced relations thereto to direct water downwardly along the underside of bidet basin 64. Thus, when the bidet is moved from its normal position illustrated in solid lines in FIG. 5 to its raised dotted line position in FIGS. 5 and 5*a*, any water remaining in basin 64 will flow towards rear opening 78 and pass therethrough, to be redeposited into bowl 12.

The rear edge 20 of bowl 12, as illustrated in FIGS. 4, 5 and 5*a*, includes a stepped surface portion 82 having a first upwardly facing step 84 and a second upwardly facing step 86 extends between two abutment walls 88 (see FIGS. 4 and 8) at opposite sides of bowl trim 18. The rear end 90 of seat 36 is pivotally mounted above step surface 84, by the pivot pins 38 which extend through abutment walls 88. Preferably these pins are formed of stainless steel or the like to reduce friction, and are movable, so that the seat can be easily removed to facilitate cleaning of steps 84.

Likewise, the rear end 92 of bidet 60 is pivotally mounted between abutment walls 88 by removable stainless steel pins 94 or the like. The pivotal connection of bidet 60 to bowl 12 is located above step surface 86, rearwardly of the pivotal connection of seat 36 to the bowl. This pivotal arrangement permits the bidet basin to be pivoted upwardly to its storage position in order to expose toilet seat 36, independently of the seat. Likewise, the toilet seat can be readily raised to its storage position when desired. In this connection it is noted that since opening 46 in toilet seat 36 is slightly larger than the dimensions of the basin 64 of the bidet, when the toilet seat 36 is removed to its raised position it will pass about a portion of the bidet basin 64, and frictionally engage the basin in a vertical or slightly past vertical position, as illustrated in FIG. 5 so that it remains in its raised position. To aid in this nesting of the seat on the bidet basin the inner edge 46' of opening 46 is tapered to be generally complementary to the slope of the bidet basin at the raised contact point. In addition, the extensions 54 on seat 36 are dimensioned to frictionally engage the sides of bidet basin 64 in the raise position of the seat to aid in holding the seat in that raised position.

In order to maintain bidet 60 in its raised position a spring 96 is provided operatively connected at its opposite ends 98, 100 to bidet 50 and bowl 12. As illustrated in FIG. 5*a*the connection 100 for spring 96 is located at an elevation above the level of pivot pin 94 for the bidet basin, so that the spring normally biases the bidet basin to its raised position. Howeverk in the down position the weight of bidet 60 is sufficient to overcome the bias of spring 96 and the bidet 60 remains in its down position. However, upon movement of bidet in an upward direction, spring 96 urges the bidet to its full upright position and, once that position is reached, holds the bidet at that position. In order to facilitate raising the bidet to its up position the front edge thereof is provided with a recess 102 formed therein to form a finger grip enabling the user to easily raise the bidet from its down to its up position.

In order to facilitate cleaning of bowl 12, and to prevent the accumulation of water on step ledges 84, 86 as a result of upward movement of the bidet after use, these ledges are sloped, as illustrated in FIGS. 5 and 5*a*, to incline downwardly towards the water basin 16 in bowl 12. These ledges are also sloped downwardly away from abutment walls 88 towards the longitudinal center line of the bowl, as illustrated in FIG. 8. so that water on these ledges will flow towards the center of the eleges. A dished area 104 is formed at the central area at the rear of rim 18 so that all water runs off into bowl 12.

Referring again to FIGS. 1, 4 and 5, water tank 22 has a bulbous front portion 110 on its front face 112. The bulbous configuration is provided in order to allow the major portion of the tank to be narrower than conventional tanks while still allowing an adequate volume within tank 22 to contain sufficient water to properly flush the bowl. Bulbous portion 110 is shaped to be accommodated within the basin 64 of the bidet when the bidet is raised to its upper position as illustrated in FIG. 5. Generally the bulbous portion 110 of the tank is complementary to at least the front portion of basis 64 so that it can be readily received therein. In this position the bidet is out of the way and fully exposes the toilet seat to permit use thereof.

The bulbous portion 110 of the tank is surrounded by a relatively flat peripheral area 114 which is generally complementary to the flange of the bidet so that even with the bidet in its upright position a neat and pleasing appearance is provided for the composite facility of the present invention.

In order to supply water to the bidet basin a through passage or tunnel 120 is provided in the rear 20 of bowl 12. Hot and cold water valves 122, 124 are respectively mounted on the ledge 125 of the rear portion 20 of bowl 12. The valve 122 is connected to a water supply conduit 126 which can be connected in any convenient manner to a hot water supply, such as for example the hot water supply pipe normally located below the sink in a bathroom. The valve 124 on the other hand is connected by a conduit 128 to the cold water supply pipe 130 normally provided by supplying cold water to tank 22.

Figure 2:
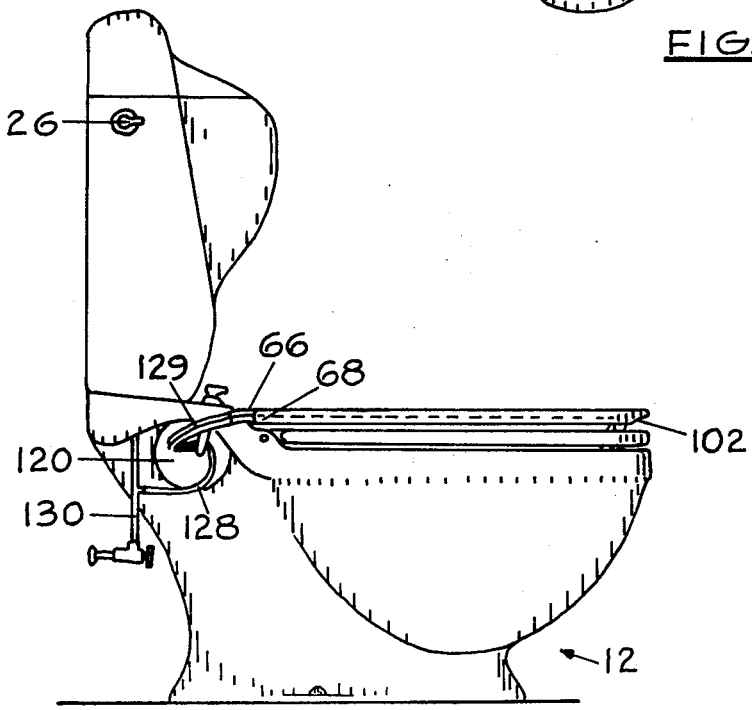
FIG. 2 is a side elevational view of the device illustrated in FIG. 1.
Figure 3:
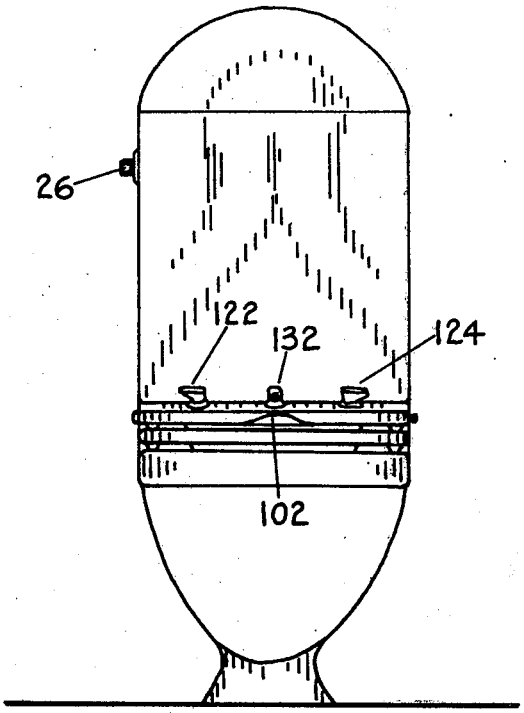
FIG. 3 is a front elevational view of the device illustrated in FIG. 1.

A counter flow control valve 132 of conventional construction is mounted between valves 122, 124 and receives hot and cold water therefrom according to the adjustment of valves 122,124. The counter flow control valve 132 is connected by conduits 129, as seen in FIGS. 4 and 2, to the water passages 66, 68 formed in bidet 60. By operating counter flow control valve 132 the user can selectively supply water to passage 66 or passage 68. Tunnel 120 in bowl 12 facilitates mounting of the valves on the bowl and the physical connection of the valves by means of conduits, pipes or tubes.

Accordingly it is seen that a relatively simply constructed composite water closet and bidet facility is provided which has a pleasing appearance, and a unitary structure, so that the facility appears as a unitized fixture, adapted for several distinct purposes. The composite compact design is relatively simple in construction and provides an integrated whole compact image. The structure is relatively easy to clean and maintain, and is particularly adapted for mass production applications. As mentioned, the bowl and tank are preferably formed of a ceramic material in the conventional manner, while the seat and bidet may be formed of molded plastic or the like in order to have a smooth and hard surface warm to the touch of human skin. Moreover the compact unitized image of the device of the present invention avoids the haphazard piecemeal appearance of previously proposed composite water closets and bidets where the bidet appears as an obvious afterthought and not as an integral portion of the fixture.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of the invention.

What is claimed is:

1. A composite water closet and bidet comprising a bowl defining a water basin, said bowl having a rear edge portion, a water storage tank positioned adjacent said rear edge portion and in fluid communication with said water basin, a toilet seat pivotally mounted on said bowl, said toilet seat having an opening therein and providing a seating surface on the bowl; a bidet basin pivotally mounted on said bowl above said seat, said basin having a peripheral seating flange surface overlying the seating surface of said toilet seat and having a basin portion extending through the opening of said toilet seat into said bowl; said water tank having a front surface including a bulbous portion formed therein which is generally complementary to a portion of said bidet basin portion of the bidet basin to be received in said basin portion when the bidet basin is pivoted upwardly towards said tank to provide a compact storage configuration for the raised bidet basin; said bidet basin portion including a base having a drain opening formed therein, means for selectively opening and closing said drain opening, and an upper rear edge portion adjacent said seating flange having an auxiliary overflow drain opening formed therein for permitting drainage of the bidet basin in its raised position.

2. A composite water closet and bidet as defined in claim 1 wherein said basin portion includes a protective shield adjacent to and spaced exteriorly from said auxiliary drainage opening to direct water in the basin into said bowl when the basin is filled above a predetermined level.

3. A composite water closet and bidet comprising a bowl defining a water basin, said bowl having a rear edge portion, a water storage tank positioned adjacent said rear edge portion and in fluid communication with said water basin, a toilet seat pivotally mounted on said bowl, said toilet seat having an opening therein and providing a seating surface on the bowl; a bidet basin pivotally mounted on said bowl above said seat, and basin having a peripheral seating flange surface overlying the seating surface of said toilet seat and having a basin portion extending through the opening of said toilet seat into said bowl; said water tank having a front surface including a bulbous portion formed therein which is generally complementary to a portion of said basin portion of the bidet basin to be received in said basin portion when the bidet basin is pivoted upwardly towards said tank to provide a compact storage configuration for the raised bidet basin; said rear edge portion of said bowl having first and second ledges formed thereon in stepped relation to each other with said second ledge being at a higher elevation than the first ledge and located rearwardly therefrom with respect to the water basin, said toilet seat and bidet basin flange having rer portions respectively overlying said first and second ledges; said ledges having upwardly facing steps which are inclined downwardly toward said water basin; and said ledges being also sloped towards their centers and providing a central dished area directed towards said water basin.

4. A composite water closet and bidet comprising a bowl defining a water basin, said bowl having an upper rim including a rear edge portion, a toilet seat pivotally mounted on said bowl adjacent said rear edge portion thereof and overlying said rim, said toilet seat having an opening therein and providing a seating surface on the bowl; a bidet basin pivotally mounted on said bowl adjacent said rear edge portion above said seat, said basin having a peripheral seating flange overlying the seating surface of said toilet seat and having a basin portion extending through the opening of said seat into said bowl; said toilet seat seating surface and said bidet flange seating surface being generally complementary in plan; said rear edge portion of said bowl having first and second ledges formed thereon in stepped relation to each other with said second ledge being at a higher elevation than the first ledge and located rearwardly therefrom with respect to the water basin, said toilet seat and bidet basin flange having rear portions respectively overlying said first and second ledges; said ledges having upwardly facing steps which are inclined downwardly towards said water basin; and said ledges also being sloped towards their centers to provide a central dished area directed towards said water basin.

5. A composite water closet in bidet as defined in claim 4 wherein said bowl rim has, in plan, relatively straight parallel spaced side portions, an arcuate front edge portion and a generally arcuate rear edge portion; said opening in said seat being generally complementary to said rim and said seating surface thereof having a pair of opposed inwardly extending surface portions overlying the bowl along the parallel sides of the rim.

6. A composite water closet and bidet as defined in claim 5 wherein said bidet seating flange is generally complementary in configuration to the seating surface of said toilet seat and slightly wider than said seating surface.

7. A composite water closet and bidet as defined in claim 4 wherein said bidet basin portion includes an upper rear edge portion, adjacent said seating flange, having an auxiliary drain opening formed therein to permit overflow drainage and drainage of the basin it its raised position.

8. A composite water closet and bidet comprising a water closet adapted to receive a bidet and a bidet adapted to be received by said water closet; said adapted water closet including a bowl defining a water basin and a siphon passageway in fluid communication with said water basin, said water closet having an upper peripheral rim surrounding said basin including a rear edge portion; and an adapted toilet seat overlying said upper rim of said water basin and being pivotally connected to said water basin adjacent said rear edge portion of said rim; said adapted bidet comprising a bidet basin having a bidet seat portion and a bidet basin portion, said bidet seat portion normally overlying said toilet seat and being pivotally connected to said water basin adjacent said rear edge portion of said rim said bidet basin portion having an upper edge and being integrally connected along said upper edge to the inner peripheral edge of said bidet seat portion and extending through the opening of said adapted toilet seat and being received by said adapted water basin; said toilet seat and said bidet seat portion having similar configurations in plan and having an approximate figure configuration of their openings.

9. A composite water closet and bidet as defined in claim 8 wherein said siphon passageway having an inner wall over which water flows from said water basin, said siphon passageway also having an inverted U-shaped portion formed over said wall to lift the liquid contennt of said water basin over said wall during siphon action, the highest elevation of said inverted U-shaped portion being at a predetermined distance below said bidet basin to prevent the water level in said water basin from touching the underside of said bidet basin portion when the water level rises to its highest elevation prior to commencement of siphon action.

10. A composite water closet and bidet as defined in claim 8 wherein said toilet seat and said bidet seat portion have straight rear edges; said rear edge portion of the water closet having a stepped configuration adjacent said straight rear edges, the lower step being on the same plane with said toilet seat and underlying said straight rear edge of said bidet seat portion, the upper step being on the ame plane with said bidet seat portion; said upper and lower steps also being sloped towards said water basin.

11. A composite water closet and bidet as defined in claim 8 wherein said bidet basin portion includes an upper rear edge portion, adjacent said bidet seat portion, having an overflow drain opening therein, said bidet basin portion also including a lower basin portion at the lowest elevation of said basin portion, having a drain opening therein.

12. A composite water closet and bidet as defined in claim 11 wherein said bidet basin includes a shield exteriorly of said overflow drain opening to direct overflow water directly downward into the water basin along the exterior side of the rearward portion of said bidet basin portion, said shield providing an aperture, adjacent said bidet seat portion, allowing water to drain directly downward into said water basin along the underside of the rearward portion of said bidet seat portion when said bidet basin is in the vertical pivotal position.

13. A composite water closet and bidet as defined in claim 12 wherein said underside of the rearward portion of said bidet seat portion has a valley carved therein to direct the water from said overflow drain opening along the center of said underside when said bidet basin is in the vertical position.

14. A composite water closet and bidet as defined in claim 11 wherein said bidet basin includes two water passages thereink starting in said bidet seat portion adjacent said rear edge portion of said bowl and respectively terminating at the upper edge of said bidet basin portion adjacent said bidet seat portion and in the bottom of said basin portion.

15. A composite water closet and bidet as defined in claim 14 wherein said water closet includes water control means mounted on said rear edge portion of said bowl.

16. A composite water closet and bidet as defined in claim 15 inluding a pair of water supply conduits connecting said water control means to the ends of said two water passages adjacent said seating flange.

17. A composite water closet and bidet as defined in claim 16 wherein said water closet has a cavity formed therein under said rear edge portion below said water control means, providing space for connections of said water control means with said flexible supply conduits and with hot and cold water supply means.

18. A composite water closet and bidet as defined in claim 8 wherein said bidet basin being connected to said rear edge portion of said water closet along a pivot axis rearwardly spaced from the pivot axis of said toilet seat; said adapted toilet seat and said bidet basin portion both having front portions shaped to allow the underside of the front portion of said basin portion and the inner edge of said front portion of said toilet seat to slide by each other along parallel surfaces of contact having a maximum angle of 45 degrees or less with respect to the plane of the toilet seat to prevent jamming of said front portions when both bidet basin and toilet seat are lifted simultaneously, said jamming being caused by the continuous increase or decrease of vertical distance of said front portions during simultaneous upward or downward movement due to the shorter turning radius of the toilet seat relative to the longer turning radius of the bidet basin.

19. A composite water closet and bidet as defined in claim 8 wherein said water closet includes an adapted water tank in fluid communication with said water basin and positioned on top of said rear edge portion; said water tank having a front surface being parallel to said bidet seat portion when the bidet basin is pivoted upwardly towards said tank to provide a corresponding storage plane for the raised bidet basin to rest against, said front surface also having a peripheral configuration being generally complementary to the peripheral configuration of said bidet seat portion to provide a compact storage configuration for said bidet basin.

20. A composite water closet and bidet as defined in claim 19 wherein said compact storage configuration of said tank for said bidet basin also includes a bulbous portion formed on said corresponding storage plane which is generally complementary to a portion of said bidet basin portion when said bidet basin is resting against said corresponding storage plane to provide additional water storage volume for the tank if so required.

21. A composite water closet and bidet as defined in claim 19 including water control means mounted on said rear edge portion of said bowl and wherein said tank has a carved-out lower front portion to provide space for water control means in fluid communication with said bidet basing said carried-out front portion also providing adequate clearance for the sightlines from the user's eyes to said water controls.

22. A composite water closet and bidet as defined in claim 8 wherein said rear edge portion of said water closet and said bidet seat portion adjacent said rear edge portion are connected by a spring or any other suitable elastic contrivance for aiding to lift said bidet basin into a vertical position, for holding said bidet basin in said vertical position and for counterbalancing the weight of said bidet basin when the same is lowered into its horizontal position.

23. A composite water closet and bidet as defined in claim 8 wherein said rear edge portion of the water closet has abutment walls formed thereon, located opposite each other and parallel to the sides of said rear edge portion, said toilet seat and said bidet seat portion each having opposite rear end portions adjacent said abutment walls, pins being inserted through said abutment walls into said opposite rear end portions to provide for pivotal connections.

24. A composite water closet and bidet as defined in claim 8 wherein said bidet seat portion has a front edge portion including a recess formed therein facing said toilet seat below to define a finger grip to aid the user's hand in lifting said bidet basin at a predetermined location.

* * * * *

UNITED STATES PATENT AND TRADEMARK OFFICE

CERTIFICATE OF CORRECTION

PATENT NO. : 4,145,767

DATED : March 27, 1979

INVENTOR(S) : Manfred Ibel

It is certified that error appears in the above-identified patent and that said Letters Patent are hereby corrected as shown below:

Column 2, line 54, after "tank removed." delete "to"; line 59, after "material in" delete "this" and insert in its place --the-; line 64, "conventional" should read --convenient--.
Column 3, line 5, "water passae" should read --water passage--; line 28, "dimensionns approximately equael" should read --dimensions approximately equal--. Column 4, line 24, after "step 86" "extends" should read--extending--; line 61, "Howeverk" should read --However--. Column 6, line 55, after "said seat," "and" should read --said--. Column 7, line 3, after "ing" "rer" should read --rear--;
Column 8, line 5, after "approximate figure" insert --eight shape--; line 11, "contennt" should read --content--; line 26, "the ame plane" should read --the same plane--; line 54, "thereink" should read --therein--;

Column 10, line 11, "basing said carried-out" should read --basin, said carved-out".

Signed and Sealed this

First Day of January 1980

[SEAL]

Attest:

SIDNEY A. DIAMOND

Attesting Officer

Commissioner of Patents and Trademarks